US008777643B2

(12) United States Patent
De France

(10) Patent No.: US 8,777,643 B2
(45) Date of Patent: Jul. 15, 2014

(54) GROUND STRAP SHIELD CONNECTOR

(75) Inventor: Robert V. De France, Poughkeepsie, NY (US)

(73) Assignee: Hubbell Incorporated, Shelton, CT (US)

( * ) Notice: Subject to any disclaimer, the term of this patent is extended or adjusted under 35 U.S.C. 154(b) by 78 days.

(21) Appl. No.: 13/587,309

(22) Filed: Aug. 16, 2012

(65) Prior Publication Data

US 2014/0051271 A1 Feb. 20, 2014

(51) Int. Cl.
*H01R 13/648* (2006.01)

(52) U.S. Cl.
USPC ..... 439/99; 174/78

(58) Field of Classification Search
USPC ..... 439/99, 98; 174/78
See application file for complete search history.

(56) References Cited

U.S. PATENT DOCUMENTS

| | | | | |
|---|---|---|---|---|
| 3,594,691 | A * | 7/1971 | Neal | 174/88 R |
| 3,676,836 | A | 7/1972 | Gillemot | |
| 3,701,839 | A * | 10/1972 | Smith | 174/78 |
| RE28,468 | E | 7/1975 | Baumgartner | |
| 4,310,209 | A | 1/1982 | Fleming | |
| 4,503,283 | A * | 3/1985 | Hancock et al. | 174/22 R |
| 4,620,755 | A | 11/1986 | Yonkers | |
| 4,895,525 | A | 1/1990 | Leonardo | |
| 5,491,766 | A * | 2/1996 | Huynh et al. | 385/100 |
| 6,019,615 | A * | 2/2000 | Masuda | 439/99 |
| 6,152,746 | A * | 11/2000 | Brown | 439/99 |
| 8,002,575 | B2 * | 8/2011 | Li et al. | 439/465 |
| 8,070,509 | B2 | 12/2011 | Luzzi | |
| 2003/0157826 | A1 | 8/2003 | Moreno | |
| 2007/0066101 | A1 * | 3/2007 | Suzuki | 439/99 |

* cited by examiner

*Primary Examiner* — Gary Paumen
(74) *Attorney, Agent, or Firm* — Kyle Hepner; Mark S. Bicks; Alfred N. Goodman

(57) ABSTRACT

A ground strap shield connector assembly includes first and second ground strap shield connectors connected to ends of first and second cables. The first and second ground strap shield connectors include first and second substantially cylindrical support sleeves disposed between an inner insulation layer and a ground shield of the first and second cables, respectively. First and second connecting members are disposed on a portion of the ground shields of the first and second cables such that the first and second connecting members surround the first and second support sleeves, respectively. A ground strap has a first end connected to the first connecting member secured to the first cable and a second end connected to the second connecting member secured to the second cable.

16 Claims, 7 Drawing Sheets

GROUND STRAP SHIELD CONNECTOR

FIELD OF THE INVENTION

The present invention relates generally to a ground strap shield connector disposable on a cable. More particularly, the present invention relates to a ground strap shield connector having a support sleeve disposable between an inner insulation layer and a ground shield of a cable and a connecting member disposable on the ground shield substantially surrounding the support sleeve. Still more particularly, the present invention relates to a first ground strap shield connector disposable on a first cable, a second ground strap shield connector disposable on a second cable, and a ground strap connecting the first and second ground strap shield connectors to maintain continuity of a ground shield of the first and second cables.

BACKGROUND OF THE INVENTION

Conventional shielded cable typically includes an inner power carrying conductor covered by an inner insulation layer, which is covered by a ground shield. An outer insulation layer covers the ground shield. When two shielded cables are spliced together, the ground shields cannot be disrupted and continuity therebetween must be maintained.

Existing methods for connecting ground shields of cables being spliced together are labor intensive and difficult. The ground shield is typically entirely covered by the outer insulation layer, which must be removed to expose the ground shield. The ground shield must then be separated from the inner insulation layer. The separated ground shield is then twisted together to form a substantially cylindrical and solid-shaped conductor. The twisted ground shield is inserted in a terminal lug connector. A jumper cable is attached to the terminal lug to be connected to a corresponding terminal lug on the other cable, which has been prepared in the same manner. The jumper cable running between the terminal lugs at each cable end maintains the continuity of the ground shields. Accordingly, a need exists for more quickly and easily maintaining continuity of the ground shields of two cables being spliced together.

SUMMARY OF THE INVENTION

An object of the present invention is to provide a ground strap shield connector for connecting ground shields of cables being spliced together to maintain continuity of the ground shields.

Another object of the present invention is to provide a ground strap shield connector that is quickly and easily connected to a first cable to be spliced to second cable.

The foregoing objectives are basically attained by a ground strap shield connector assembly including first and second ground strap shield connectors connected to ends of first and second cables. The first and second ground strap shield connectors include first and second substantially cylindrical support sleeves disposed between an inner insulation layer and a ground shield of the first and second cables, respectively. First and second connecting members are disposed on a portion of the ground shields of the first and second cables such that the first and second connecting members surround the first and second support sleeves, respectively. A ground strap has a first end connected to the first connecting member secured to the first cable and a second end connected to the second connecting member secured to the second cable.

The foregoing objectives are also basically attained by a ground strap shield connector assembly kit including first and second ground strap shield connectors connectable to ends of first and second cables. The first and second ground strap shield connectors include first and second substantially cylindrical support sleeves disposable between an inner insulation layer and a ground shield of the first and second cables, respectively. First and second connecting members are disposable on a portion of the ground shields of the first and second cables such that the first and second connecting members surround the first and second support sleeves, respectively. A ground strap has a first end connectable to the first connecting member securable to the first cable and a second end connectable to the second connecting member securable to the second cable.

The foregoing objectives are also basically attained by a method of splicing cables including the steps of inserting a first support sleeve between an inner insulative layer and a ground shield of a first cable. A first connecting member is disposed on the ground shield of the first cable such that the first connecting member surrounds the first support sleeve. A ground strap is connected to the first connecting member.

Objects, advantages, and salient features of the invention will become apparent from the following detailed description, which, taken in conjunction with the annexed drawings, discloses exemplary embodiments of the present invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numerals will be understood to refer to like parts, components and structures.

DETAILED DESCRIPTION OF EXEMPLARY EMBODIMENTS

Figure 1:
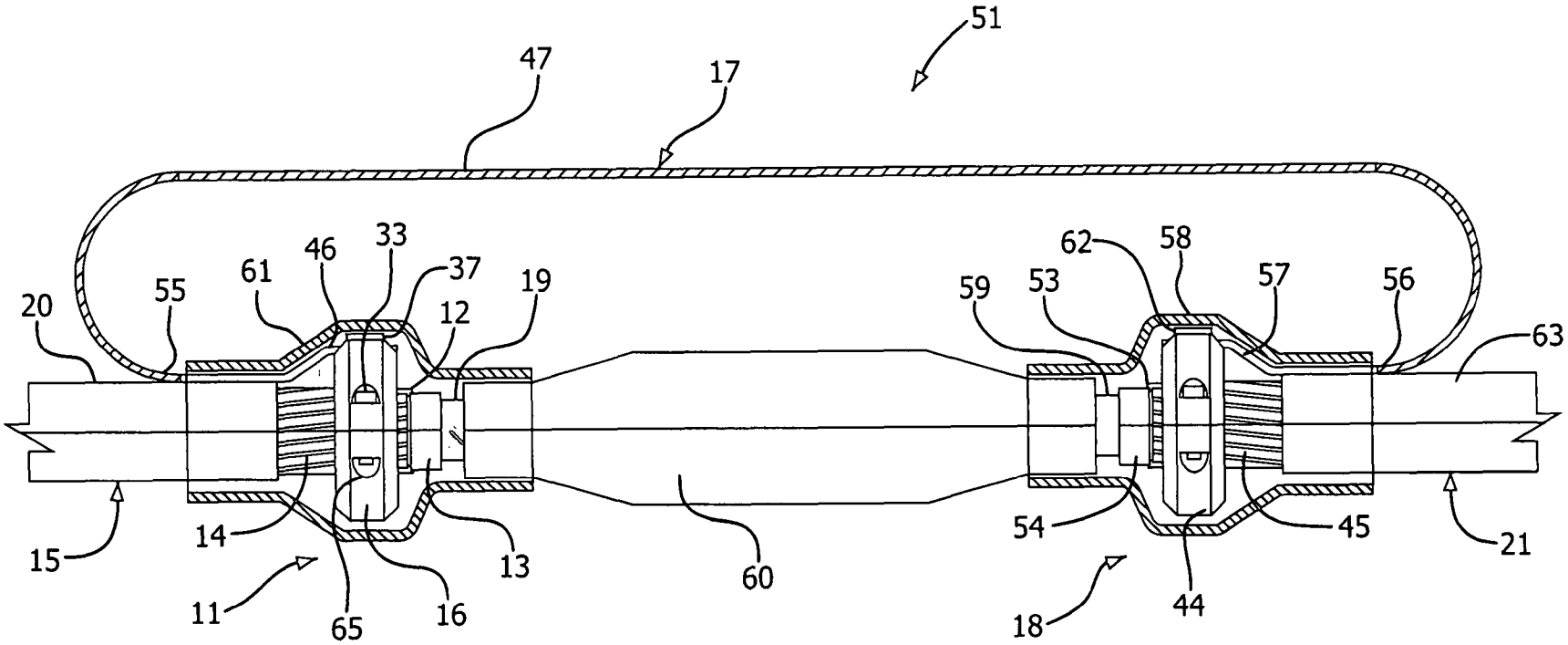
FIG. 1 is a side elevational view of two ground strap shield connectors in partial cross section connecting two shielded cables in accordance with a first exemplary embodiment of the present invention.

A ground strap shield connector 11 in accordance with a first exemplary embodiment of the present invention includes a substantially cylindrical support sleeve 12 disposable between an inner insulation layer 13 and a ground shield 14 of a cable 15, as shown in FIGS. 1-12. A connecting member 16 is disposed on a portion of the ground shield 14 such that the connecting member 16 substantially surrounds the support sleeve 12. A ground strap 17 has a first end connected to the connecting member 16 and a second end connected to another connecting member 44, thereby maintaining the continuity of the ground shield. The ground strap shield connector 11 of the first exemplary embodiment of the present invention can be used with any cable having a ground shield.

Figure 3:
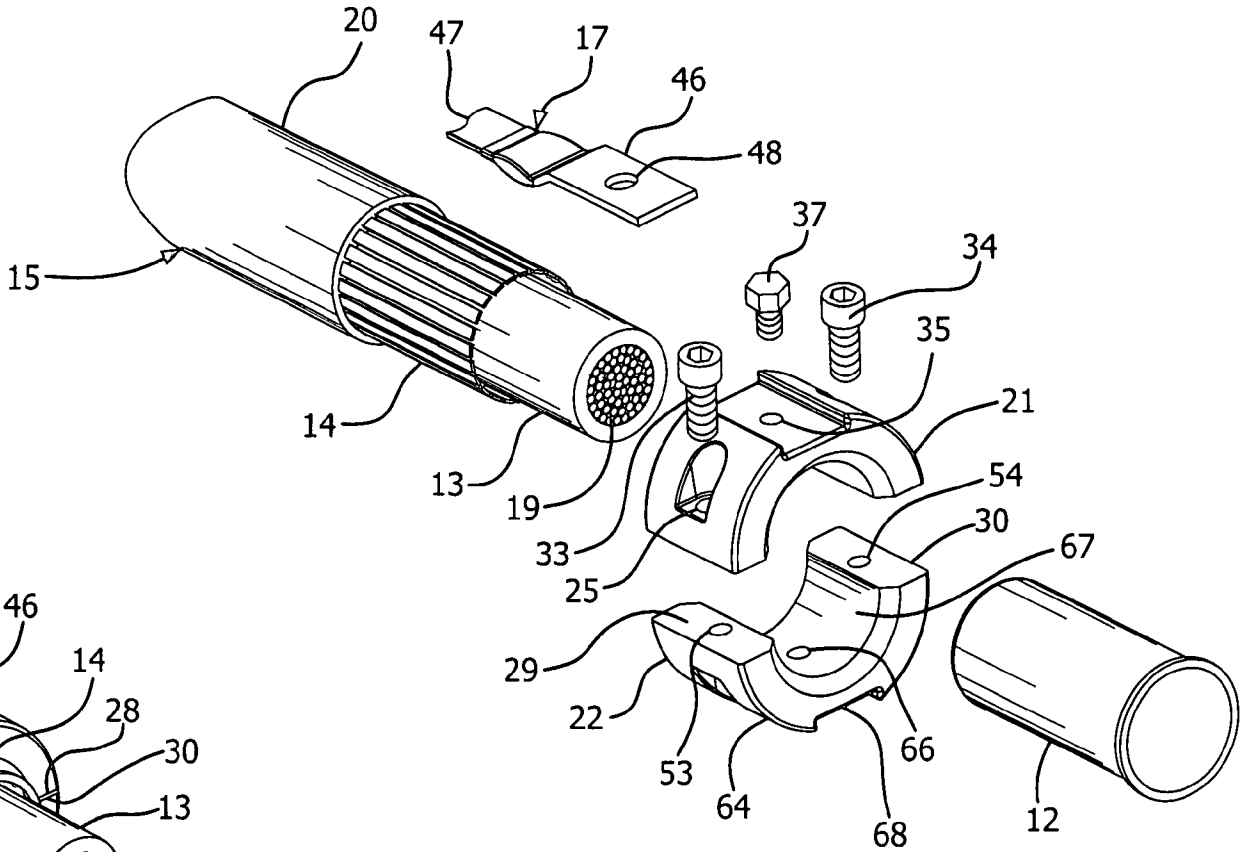
FIG. 3 is an exploded perspective view of the ground strap shield connector of FIG. 2.
Figure 2:
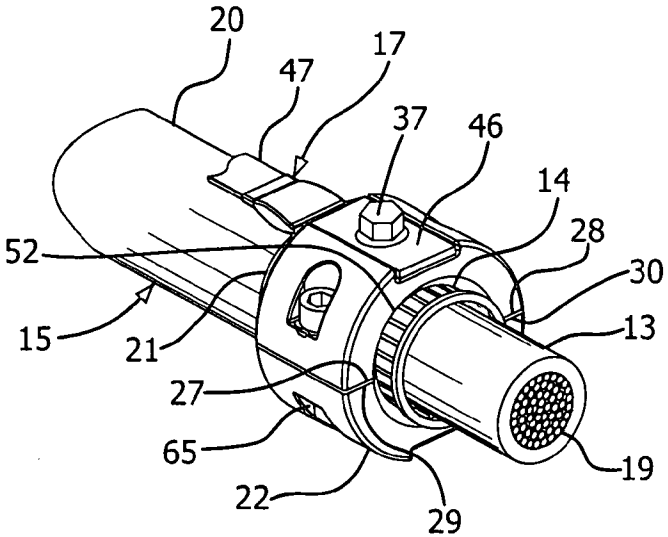
FIG. 2 is a perspective view of the ground strap shield connector of FIG. 1 connected to a shielded cable.
Figure 4:
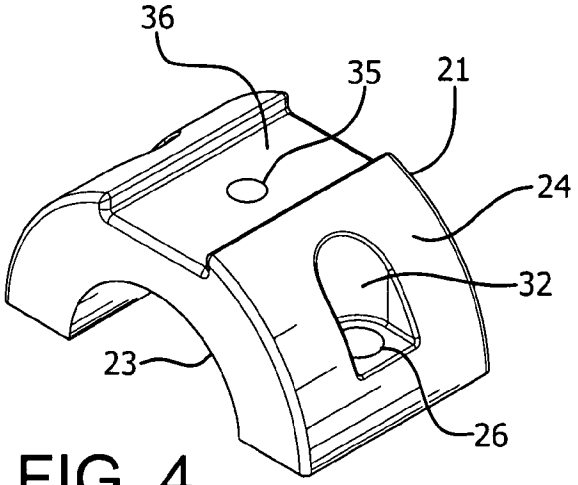
FIG. 4 is a perspective view of an upper member of a ground connector of FIG. 1.

The first cable 15 includes a conductor 19 surrounded by the inner insulation layer 13, as shown in FIGS. 2 and 3. The ground shield 14 surrounds the inner insulation layer 13. An outer insulation layer 20 surrounds the ground shield 14. Portions of the inner insulation layer 13, the ground shield 14 and the outer insulation layer 20 are removed from the cable 15 to prepare the cable to be spliced with a second cable 21, as shown in FIG. 1.

The connecting member 16 preferably has an upper member 21 and a lower member 22, as shown in FIG. 3. The lower member 22 has an inner surface 23 adapted to engage the ground shield 14 of the cable 15. An outer surface 24 and the inner surface 23 are preferably substantially semi-cylindrical arcs, as shown in FIG. 6.

Figure 6:
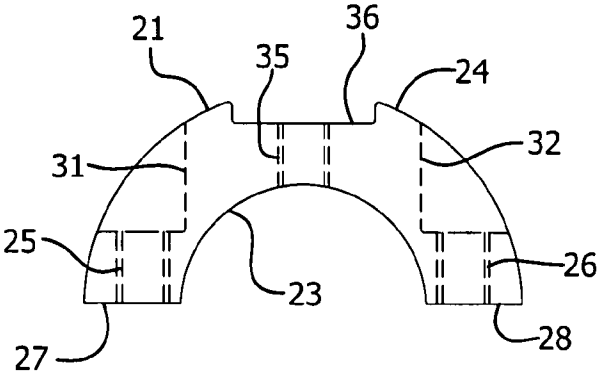
FIG. 6 is a front elevational view of the upper member of the ground connector of FIG. 4.
Figure 8:
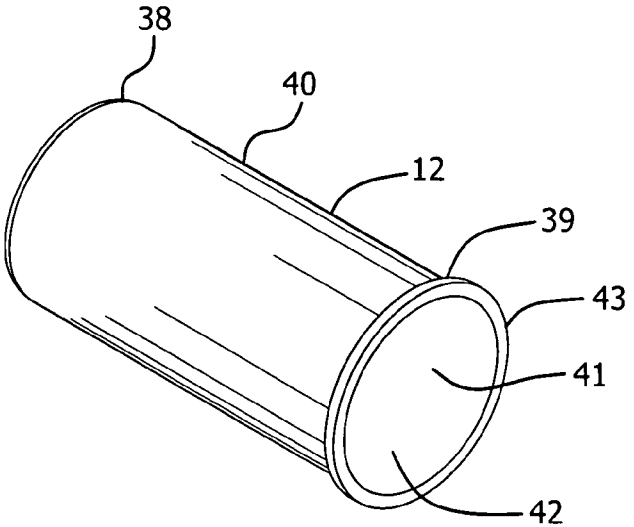
FIG. 8 is a perspective view of a support sleeve of FIG. 1.
Figure 9:
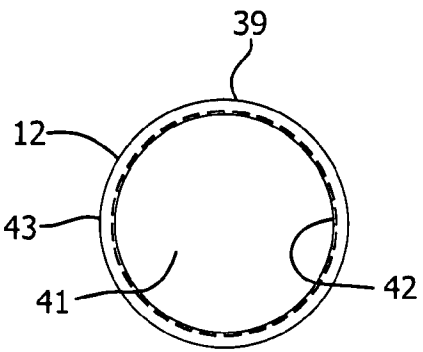
FIG. 9 is a front elevational view of the support sleeve of FIG. 8.
Figure 10:
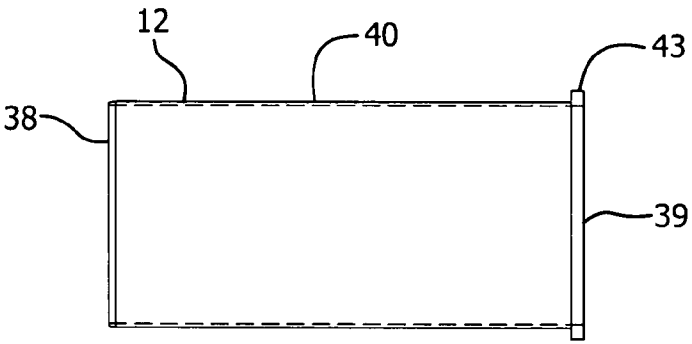
FIG. 10 is a side elevational view of the support sleeve of FIG. 8.
Figure 11:
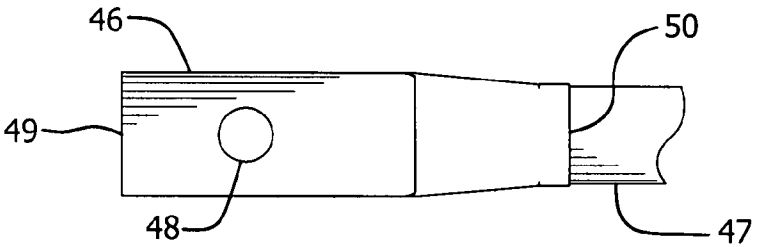
FIG. 11 is a top plan view of a terminal lug of FIG. 1.
Figure 12:
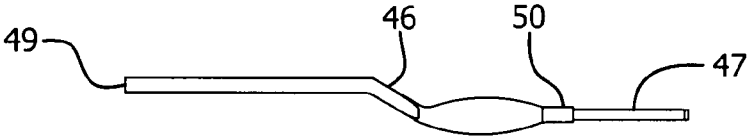
FIG. 12 is a side elevational view of the terminal lug of FIG. 11.

The upper member 21 has first and second unthreaded fastener openings 25 and 26 extending from the outer surface 24 to first and second mating surfaces 27 and 28, respectively, as shown in FIG. 6. The first and second mating surfaces 27 and 28 are flat to facilitate engaging corresponding mating surfaces 29 and 30 on the lower member 22, as shown in FIGS. 2 and 3. The first and second fastener openings 25 and 26 are formed in recesses 31 and 32 in the outer surface 24 of the upper member 21. First and second fasteners 33 and 34 are received by the first and second fastener openings 25 and 26 in the upper member 21 to secure the upper member to the lower member 22.

Figure 7:
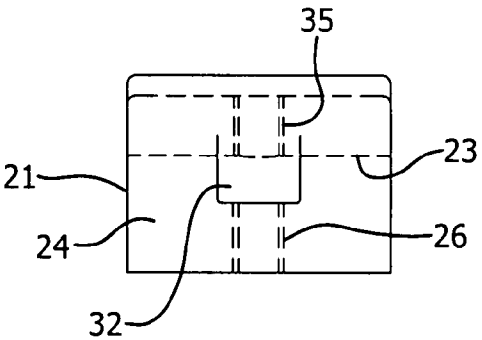
FIG. 7 is a side elevational view of the upper member of the ground connector of FIG. 4.
Figure 5:
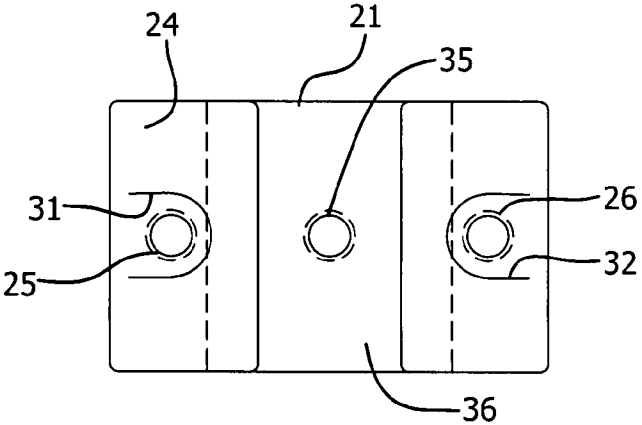
FIG. 5 is a top plan view of the upper member of the ground connector of FIG. 4.

A third fastener opening 35 extends from the outer surface 24 to the lower surface 23, as shown in FIGS. 6 and 7. The third fastener opening 35 is disposed between the first and second fastener openings 25 and 26, as shown in FIG. 5. A groove 36 is formed in the outer surface 24 of the upper member 21 and receives the ground strap 17. The third fastener opening 35 is disposed in the groove 36. The third fastener opening 35 receives a third fastener 37 to secure the ground strap 17 to the upper member 21. Preferably, the third fastener 37 is a hex head bolt. The third fastener opening 35 is preferably threaded.

The lower member 22 has first and second threaded fastener openings 53 and 54 extending from the outer surface 64 to first and second mating surfaces 29 and 30, respectively, as shown in FIG. 3. The first and second mating surfaces 29 and 30 are flat to facilitate engaging corresponding mating surfaces 27 and 28 on the upper member 21, as shown in FIGS. 2 and 3. The first and second fastener openings 53 and 54 are formed in recesses 65 in the outer surface 64 of the lower member 22. The first and second fasteners 33 and 34 are threadably received by the first and second fastener openings 53 and 54 in the lower member 22 to secure the lower member to the upper member 21.

A third fastener opening 66 extends from the outer surface 64 to the inner surface 67, as shown in FIG. 3. The third fastener opening 66 is disposed between the first and second fastener openings 53 and 54, as shown in FIG. 3. A groove 68 is formed in the outer surface 64 of the lower member 22. The third fastener opening 66 is disposed in the groove 68. The third fastener opening 66 is preferably threaded. The lower member 22 is substantially similar to the upper member 21 with the exception that the first and second fastener openings 25 and 26 of the upper member 21 are not threaded, and the first and second fastener openings 53 and 54 of the lower member 22 are threaded.

The support sleeve 12 is substantially cylindrical, as shown in FIGS. 3 and 8-10. The support sleeve 12 is disposed between the inner insulation layer 13 and the ground shield 14, as shown in FIGS. 1 and 2. An opening 41 in the support sleeve 12 extends from a first end 38 to a second end 39. An inner surface 42 of the support sleeve 12 substantially surrounds the inner insulation layer 13. An outer surface 40 of the support sleeve 12 is proximal the ground shield 14. A flange 43 can extend outwardly from the second end 39 of the support sleeve 12 to facilitate gripping the support sleeve during installation. The flange 43 can also limit the insertion depth of the support sleeve 12 between the inner insulation layer 13 and the ground shield 14.

A ground strap 17 extends from the first connecting member 16 to the second connecting member 44, as shown in FIG. 1, to maintain continuity of the ground shields 14 and 45. The ground strap 17 includes a terminal lug 46 and a braided wire 47. The terminal lug 46 has a fastener opening 48 proximal a first end 49 that receives the third fastener 37 to secure the terminal lug to the upper member 21 of the connecting member 16. The braided wire 47 is connected to the second end 50 of the terminal lug 46 in any suitable manner, such as by crimping. A second 56 of the braided wire 47 is connected to a second terminal lug 57 in a substantially similar manner.

Preferably, the upper and lower members 21 and 22 of the connecting member 16 are each unitarily formed as a single piece and are made of brass. The support sleeve 12, the terminal lug 46 and the braided wire 47 are preferably made of copper.

Assembly and Operation

An assembled ground strap shield connector assembly 51 is shown in FIG. 1 and includes the ground strap 17 connecting the first connecting member 16 connected to the ground shield 14 of the first cable 15 to the second connecting member 44 connected to the ground shield 45 of the second cable 21.

To connect the first connecting member 16 to the first cable 15, a portion of the outer insulation layer 20 is removed to expose the ground shield 14. Portions of the ground shield 14 and inner insulation layer 13 are removed to expose the conductor 19. The ground shield 14 is separated from the inner insulation layer 13 such that the support sleeve 12 can be inserted between the inner insulation layer 13 and the ground shield 14.

The upper and lower connecting members 21 and 22 are disposed on the ground shield 14 such that the first and second mating surfaces 27 and 28 of the upper member 21 contact the first and second mating surfaces 29 and 30 of the lower member 22, as shown in FIG. 2. The first fastener 35 is inserted through the first unthreaded fastener opening 25 in the upper member 21 and the corresponding threaded fastener opening 53 in the lower member 22. The second fastener 34 is inserted through the second unthreaded fastener opening 26 in the upper member 21 and the corresponding threaded fastener opening 54 in the lower member 22.

The support sleeve 12 is then passed through an opening 52 formed by the connected upper and lower members 21 and 22 such that the connecting member 16 is positioned over the support sleeve 12. The flange 43 can be gripped to facilitate inserting the support sleeve 12. The inner surface 42 of the support sleeve 12 is adjacent the inner insulation layer 13 and the outer surface 40 is adjacent the ground shield 14. The first and second fasteners 33 and 34 are then tightened to secure the connecting member 16 and support sleeve 12 to the cable 15.

The second ground strap shield connector 18 is connected to the second cable 21 in a substantially similar manner as installation of the first ground strap shield connector 11. The second connecting member 44 is connected to the second cable 21 such that the second support sleeve 53 is disposed between the inner insulation layer 54 and the ground shield 45 of the second cable 21.

The first terminal lug 46 is disposed in the groove 46 of the upper member 21 of the first connecting member 16. The third fastener 37 passes through the fastener opening 48 in the terminal lug 46 and the third fastener opening 35 in the upper connecting member 21 to secure the terminal lug 46 to the first connecting member 16. A first end 55 of the braided wire 47 is connected to the first terminal lug 46. A second end 56 of the braided wire 47 is connected to the second terminal lug 57. A fastener 58 secures the second terminal lug 57 to the second connecting member 44. Preferably, the first and second ends 55 and 56 of the braided wire 47 are crimped to the first and second terminal lugs 46 and 57, respectively. The ground shields 14 and 45 of the first and second cables 15 and 21 are connected such that the continuity thereof is maintained.

The conductor 19 of the first cable 21 and a conductor 59 of the second cable 21 are inserted in opposite ends of a cylindrical tube (not shown). The cylindrical tube is then crimped to secure the conductors 19 and 59 thereto. The cylindrical tube is preferably either aluminum or copper and is determined by the conductor material. An insulating material 60, such as rubber, covers the crimped tube. A first heat shrinking member 61 covers the first ground strap connecting member 11 and extends from the outer insulation layer 20 to the insulating material 60 of the crimped tube. A second heat shrinking member 62 covers the second ground strap connecting member 18 and extends from an outer insulation layer 63 of the second cable 21 to the insulating material 60 of the crimped tube. Heat is then applied to the first and second heat shrinking members 61 and 62 to seal the connections at each end of the cables 15 and 21. The rounded outer surface 24 of the connecting members 16 and 44 facilitate heat shrinking the heat shrinking members 61 and 62 thereon, and substantially prevent tearing of the heat shrink members 61 and 62.

Second Exemplary Embodiment

Figure 13:
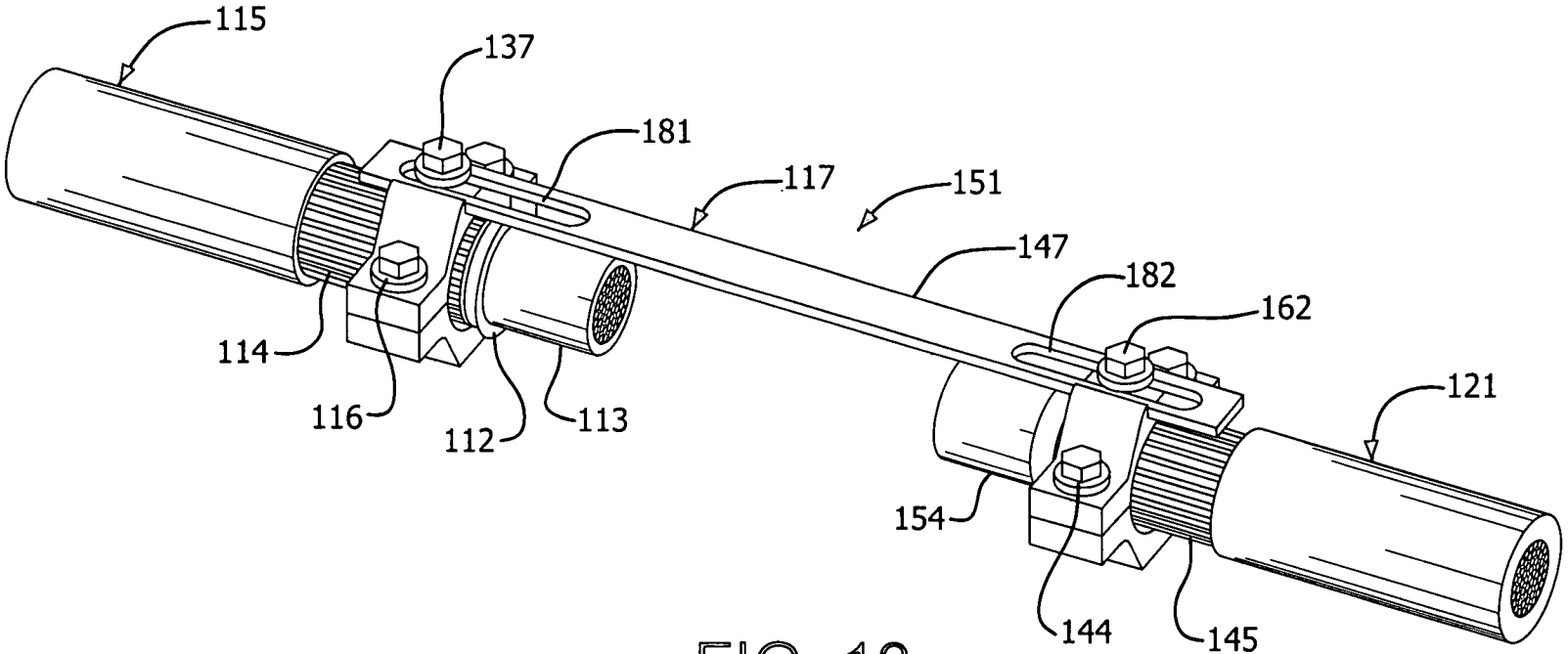
FIG. 13 is a perspective view of two ground strap shield connectors connecting two shielded cables in accordance with a second exemplary embodiment of the present invention in which a splice is not shown for clarity.

An assembled ground strap shield connector assembly 151 in accordance with a second exemplary embodiment of the present invention is shown in FIG. 13. The ground strap shield connector assembly 151 in accordance with the second exemplary embodiment is substantially similar to the ground strap shield connector assembly 51 according to the first exemplary embodiment except as noted below. Similar elements of the second exemplary embodiment are identified with the same reference numeral as the first exemplary embodiment except in the 100 series, i.e., identified as 1xx.

Figure 14:
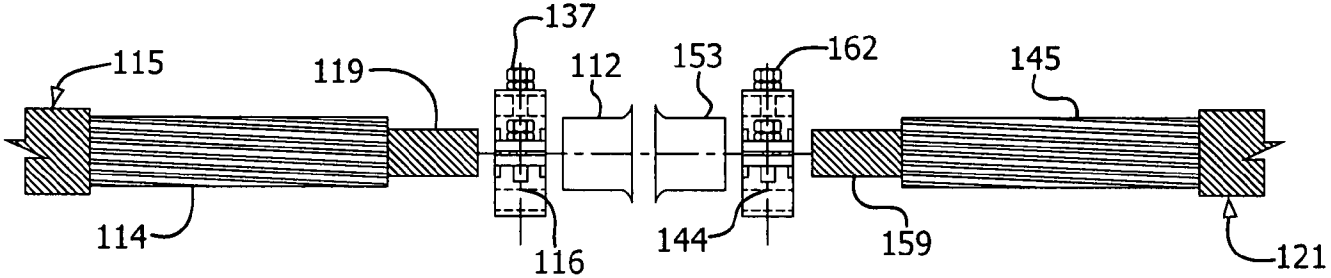
FIG. 14 is an exploded side elevational view of the two ground strap shield connectors of FIG. 13.
Figure 17:
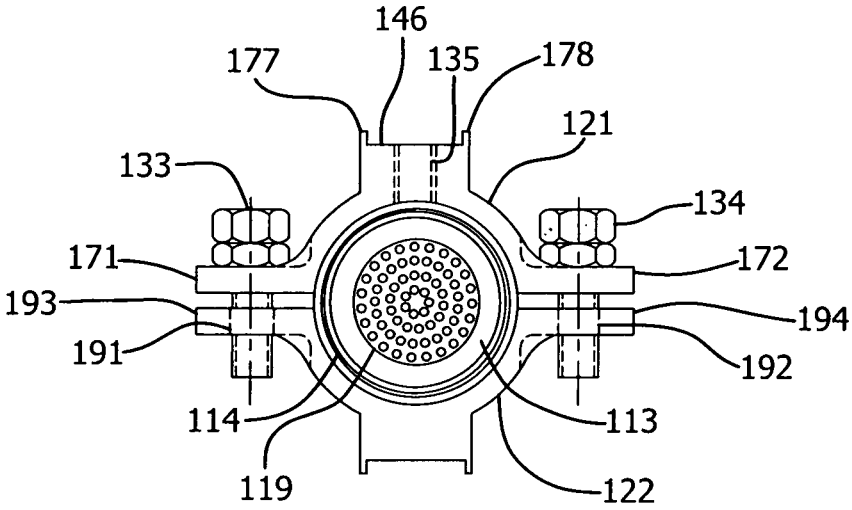
FIG. 17 is a front elevational view of the ground strap shield connector of FIG. 13.
Figure 18:
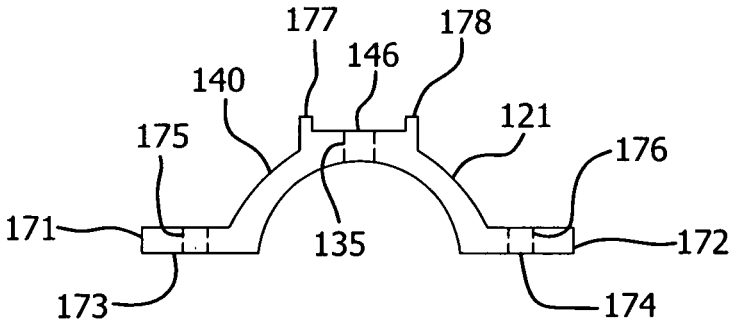
FIG. 18 is a front elevational view of an upper portion of the ground strap shield connector of FIG. 17.

The second connecting member 144 is substantially identical to the first connecting member 116. The upper member 121 has first and second outwardly extending tabs 171 and 172, as shown in FIGS. 17 and 18. Lower surfaces 173 and 174 form mating surfaces for mating with corresponding surfaces on the lower member 122. The first and second unthreaded fastener openings 175 and 176 are formed in the tabs 171 and 172. First and second protrusions 177 and 178 extend axially on the outer surface 140 of the upper member 121 to form the groove 146 therebetween. Threaded first and second fastener openings 191 and 192 in tabs 193 and 194 of the lower member 122 threadably receive the first and second fasteners 133 and 134, as shown in FIGS. 13, 14 and 17. The lower member 122 is substantially similar to the upper member 121 with the exception that the first and second fastener openings 175 and 176 of the upper member 121 are not threaded, and the first and second fastener openings 191 and 192 of the lower member 122 are threaded.

The third threaded fastener 137 is received is received in a third fastener opening 135 disposed in the groove 146 of the upper member 121, as shown in FIGS. 17 and 18. First and second fastener openings 181 and 182 in the flat ground strap 117 receive the third fasteners 137 and 162 of the first and second connecting members 116 and 144. The first and second fastener openings 181 and 182 in the ground strap are preferably elongated, as shown in FIGS. 13 and 16, to adjust for the distance between the cables 115 and 121 being spliced.

Figure 15:
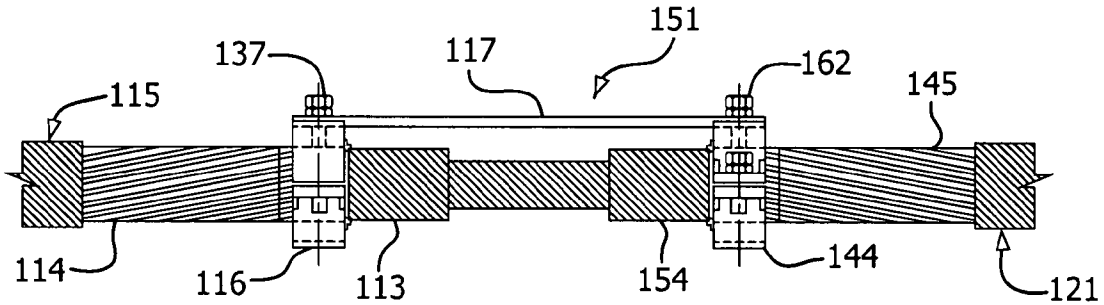
FIG. 15 is a side elevational view of the two ground strap shield connectors of FIG. 13 in which the two shielded cables are spliced together.
Figure 16:
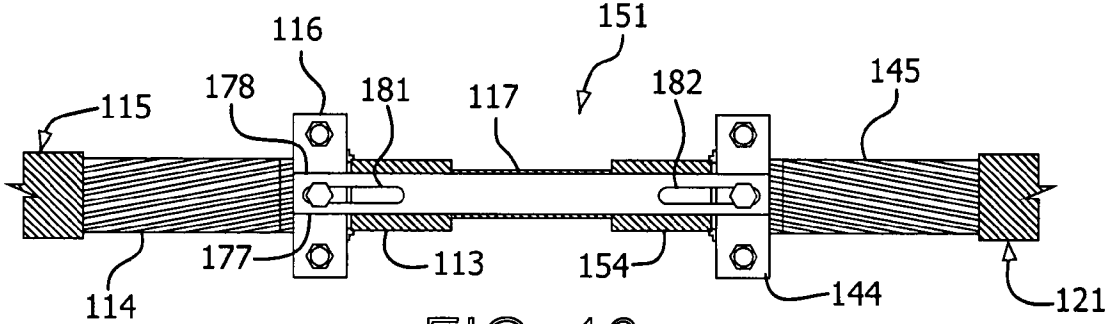
FIG. 16 is a top plan view of the two ground strap shield connectors of FIG. 15.

The ground strap shield connector assembly 151 is assembled in substantially similar manner as in the first exemplary embodiment, as shown in FIGS. 14-16. The ground strap 117 connected between the first and second connecting members 116 and 144 maintains the continuity of the ground shields 114 and 145 of the first and second cables 115 and 121.

The foregoing embodiment and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A ground strap shield connector assembly, comprising:

first and second ground strap shield connectors connected to ends of first and second cables, said first and second ground strap shield connectors including, first and second substantially cylindrical support sleeves disposed between an inner insulation layer and a ground shield of the first and second cables, respectively, and first and second connecting members disposed on a portion of the ground shields of the first and second cables such that said first and second connecting members surround said first and second support sleeves, respectively, each of said first and second connecting members having an upper member adjustably connected to a lower member to facilitate disposing said first and second connecting members on said ground shields of the first and second cables; and a ground strap having a first end connected to said first connecting member secured to the first cable and a second end connected to said second connecting member secured to the second cable.

2. The ground strap shield connector assembly according to claim 1, wherein a flange extends radially outwardly from ends of each of said first and second support sleeves.

3. The ground strap shield connector assembly according to claim 1, wherein first and second protrusions extend upwardly from outer surfaces of each of said first and second connecting members to facilitate receiving said ground strap therebetween.

4. The ground strap shield connector assembly according to claim 1, wherein first and second fasteners are disposed on opposite sides of said first and second connecting members to secure said upper and lower members together.

5. The ground strap shield connector assembly according to claim 4, wherein a third fastener adjustably secures each end of said ground strap to said first and second connecting members.

6. The ground strap shield connector assembly according to claim 1, wherein said first and second connecting members each have a substantially circular circumference in cross section.

7. The ground strap shield connector assembly according to claim 4, wherein first and second fastener openings in said first and second connecting members are disposed in recesses to receive said first and second fasteners.

8. The ground strap shield connector assembly according to claim 4, wherein first and second fastener openings in said first and second connecting members are disposed in outwardly extending tabs to receive said first and second fasteners.

9. A ground strap shield connector assembly, comprising:

first and second ground strap shield connectors connected to ends of first and second cables, said first and second ground strap shield connectors including, first and second substantially cylindrical support sleeves disposed between an inner insulation layer and a ground shield of the first and second cables, respectively, and first and second connecting members disposed on a portion of the ground shields of the first and second cables such that said first and second connecting members surround said first and second support sleeves, respectively; and a ground strap having a first end connected to said first connecting member secured to the first cable, a second end connected to said second connecting member secured to the second cable, and first and second elongated slots to facilitate adjustably connecting to said first and second connecting members.

10. A ground strap shield connector assembly kit, comprising:

first and second ground strap shield connectors connectable to ends of first and second cables, said first and second ground strap shield connectors including first and second substantially cylindrical support sleeves disposable between an inner insulation layer and a ground shield of the first and second cables, respectively; and first and second connecting members disposable on a portion of the ground shields of the first and second cables such that said first and second connecting members surround said first and second support sleeves, respectively, each of said first and second connecting members having an upper member adjustably connectable to a lower member to facilitate disposing said first and second connecting members on said ground shields of the first and second cables; and a ground strap having a first end connectable to said first connecting member securable to the first cable and a second end connectable to said second connecting member securable to the second cable.

11. The ground strap shield connector assembly kit according to claim 10, wherein a flange extends radially outwardly from ends of each of said first and second support sleeves.

12. The ground strap shield connector assembly kit according to claim 10, wherein first and second protrusions extend upwardly from outer surfaces of each of said first and second connecting members to facilitate receiving said ground strap therebetween.

13. The ground strap shield connector assembly kit according to claim 10, wherein first and second fasteners are disposed on opposite sides of said first and second connecting members to secure said upper and lower members together.

14. A ground strap shield connector assembly kit, comprising:

first and second ground strap shield connectors connectable to ends of first and second cables, said first and second ground strap shield connectors including first and second substantially cylindrical support sleeves disposable between an inner insulation layer and a ground shield of the first and second cables, respectively; and first and second connecting members disposable on a portion of the ground shields of the first and second cables such that said first and second connecting members surround said first and second support sleeves, respectively; and a ground strap having a first end connectable to said first connecting member securable to the first cable, a second end connectable to said second connecting member securable to the second cable, and first and second elongated slots to facilitate adjustably connecting to said first and second connecting members.

15. A method of splicing cables, comprising the steps of inserting a first support sleeve between an inner insulative layer and a ground shield of a first cable;

disposing a first connecting member on the ground shield of the first cable such that the first connecting member surrounds the first support sleeve;

connecting a ground strap to the first connecting member;

inserting a second support sleeve between an inner insulative layer and a ground shield of a second cable;

disposing a second connecting member on the ground shield of the second cable such that the second connecting member surrounds the second support sleeve; and connecting the ground strap to the second connecting member; and sliding the ground strap with respect to the first and second connecting members to adjust for a distance therebetween.

16. The method of splicing cables according to claim 15, further comprising tightening fasteners on the first and second connecting members to secure the first and second connecting members to the first and second cables, respectively.

* * * * *